US011522322B2

(12) United States Patent
Gingrich, III et al.

(10) Patent No.: US 11,522,322 B2
(45) Date of Patent: Dec. 6, 2022

(54) NESTED HOUSING INTERFACE FOR IMPEDANCE MATCHING

(71) Applicant: TE Connectivity Services GmbH, Schaffhausen (CH)

(72) Inventors: Charles Raymond Gingrich, III, Mechanicsburg, PA (US); Graham Harry Smith, Jr., Mechanicsburg, PA (US); Michael Frank Cina, Elizabethtown, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/100,222

(22) Filed: Nov. 20, 2020

(65) Prior Publication Data

US 2022/0166169 A1 May 26, 2022

(51) Int. Cl.

| | |
|---|---|
| ***H01R 13/6473*** | (2011.01) |
| ***H01R 13/502*** | (2006.01) |
| *H01R 13/04* | (2006.01) |

(52) U.S. Cl.

CPC ..... *H01R 13/6473* (2013.01); *H01R 13/502* (2013.01); *H01R 13/04* (2013.01)

(58) Field of Classification Search

CPC ... H01R 13/6473; H01R 13/502; H01R 13/04
See application file for complete search history.

(56) References Cited

U.S. PATENT DOCUMENTS

| | | | | |
|---|---|---|---|---|
| 4,813,891 | A * | 3/1989 | Walters | H01R 13/6581 439/620.21 |
| 5,643,016 | A * | 7/1997 | Huss, Jr. | H01R 13/434 439/744 |
| 8,029,325 | B2 * | 10/2011 | Bardet | H01R 13/422 439/701 |
| 9,831,608 | B1 * | 11/2017 | Pickel | H01R 13/6473 |
| 10,431,936 | B2 * | 10/2019 | Horning | H01R 13/502 |
| 11,056,821 | B2 * | 7/2021 | Ferderer | F16L 3/223 |
| 2011/0294325 | A1 * | 12/2011 | McAlonis | H01R 12/722 439/660 |

(Continued)

OTHER PUBLICATIONS

International Search Report, International Application No. PCT/IB2021/060279, International Filing Date, Nov. 5, 2021.

*Primary Examiner* — Abdullah A Riyami
*Assistant Examiner* — Nader J Alhawamdeh

(57) ABSTRACT

An electrical connector of an electrical connector assembly. The electrical connector includes a housing with a mating face for mating with a mating electrical connector. Contact receiving cavities extend into the housing from the mating face. Contacts are provided in the contact receiving cavities. Mating portions of the contacts extend from the mating face in a direction away from the housing. Protrusions extend from the mating face in a direction away from the housing. The protrusions extend proximate edges of the mating portions of the contacts. The protrusions form reverse chamfers which cooperate with lead-in chamfers provided in a surface of the mating electrical connector. The positioning of the protrusions in the lead-in chamfers fills in air gaps provided by the lead-in chamfers to provide an impedance match along the mating portions of the contacts when the electrical connector is mated with the mating electrical connector.

16 Claims, 6 Drawing Sheets

(56) References Cited

U.S. PATENT DOCUMENTS

| | | | | |
|---|---|---|---|---|
| 2012/0052741 | A1* | 3/2012 | Zhu | H01R 12/73 439/660 |
| 2016/0172803 | A1* | 6/2016 | Tamai | H01R 12/716 439/676 |
| 2019/0097356 | A1* | 3/2019 | Horning | H01R 13/502 |
| 2019/0157812 | A1* | 5/2019 | Gailus | H01R 13/6461 |
| 2020/0028295 | A1* | 1/2020 | Soubh | H01R 13/187 |
| 2020/0328563 | A1* | 10/2020 | Smith, Jr. | H01R 12/724 |

* cited by examiner

NESTED HOUSING INTERFACE FOR IMPEDANCE MATCHING

FIELD OF THE INVENTION

The present invention is directed to an electrical connector housing with protrusions extending from a mating face for impedance matching. In particular, the invention is directed to an electrical connector housing with protrusions which that nest with lead-in chamfers in the mating face of a mating connector to fill in the air gaps around the lead-in chamfers.

BACKGROUND OF THE INVENTION

In many electrical connectors, contacts are provided in contact receiving openings provided in the housing of the connector. In order to accommodate mating of the electrical connector with a mating electrical connector, it is common for connectors to have a lead-in chamfer molded into the plastic housing on the socket side of the connector mated pair. This allows the housing on the socket side to guide the pin contacts into the socket contacts to pre-align the pins relative to the sockets. The chamfer area creates an air space around the pin contact when the connector set is fully mated. This air space causes a mis-match in the impedance compared to the adjacent areas where the pins are surrounded by housing's plastic material.

It is therefore desirable to provide a pin housing with molded-in protrusions extending up along the sides of the pin contact edges that form a reverse chamfer form along all sides of the pin. The reverse chamfer protrusions on the pin housing create nested plastic forms that fill in the air gaps around the lead-in chamfer on the socket housing.

SUMMARY OF THE INVENTION

An embodiment is directed to an electrical connector which includes a housing with a mating face for mating with a mating electrical connector. Contact receiving cavities extend into the housing from the mating face. Contacts are provided in the contact receiving cavities. Mating portions of the contacts extend from the mating face in a direction away from the housing. Protrusions extend from the mating face in a direction away from the housing. The protrusions extend proximate edges of the mating portions of the contacts. The protrusions form reverse chamfers which cooperate with lead-in chamfers provided in a surface of the mating electrical connector. As the electrical connector is mated with the mating electrical connector, the protrusions are positioned in the lead-in chamfers of the mating electrical connector. The positioning of the protrusions in the lead-in chamfers fills in air gaps provided by the lead-in chamfers to provide an impedance match along the mating portions of the contacts when the electrical connector is mated with the mating electrical connector.

An electrical connector assembly having a first electrical connector and a second electrical connector. The first electrical connector includes a first housing having a first mating face. First contact receiving cavities extend into the first housing from the first mating face. First contacts are positioned in the first contact receiving cavities. First mating portions of the first contacts extend from the first mating face in a direction away from the first housing. Protrusions extend from the first mating face in a direction away from the first housing. The protrusions extend proximate edges of the first mating portions of the first contacts. The protrusions form reverse chamfers. The second electrical connector includes a second housing having a second mating face. Second contact receiving cavities extend into the second housing from the second mating face. Second contacts are provided in the second contact receiving cavities. Second mating portions of the second contacts extend from the second mating face in a direction into the second housing. Lead-in chamfers are provided in the second mating face of the second housing. The lead-in chamfers extend from the second mating face in a direction into the second housing. As the first electrical connector is mated with the second electrical connector, the protrusions of the first electrical connector are positioned in the lead-in chamfers of the second electrical connector. The positioning of the protrusions in the lead-in chamfers fills in air gaps provided by the lead-in chamfers to provide an impedance match along the first mating portions of the first contacts when the first electrical connector is mated with the second electrical connector.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
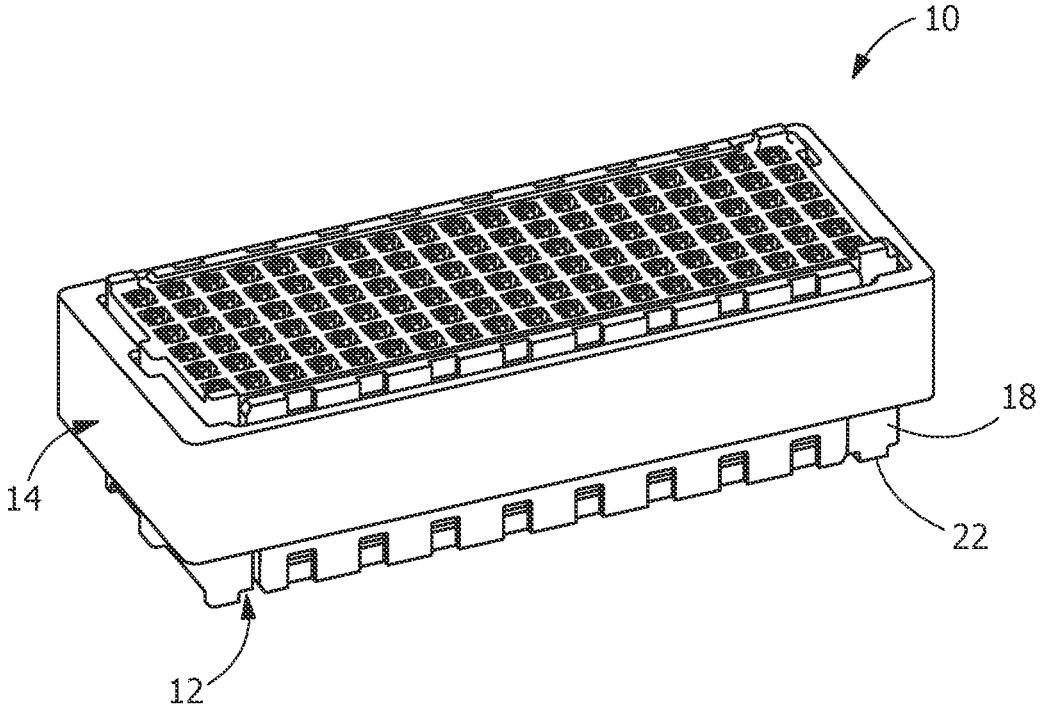
FIG. 1 is a perspective view of an illustrative male electrical connector of the present invention mated with a female mating electrical connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2A:
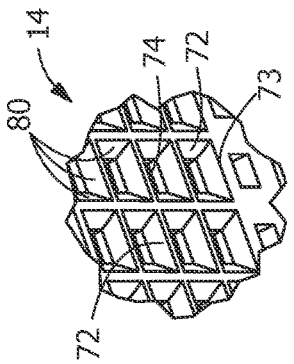
FIG. 2*a* is an enlarged perspective view of a portion of the female electrical connector.
Figure 2B:
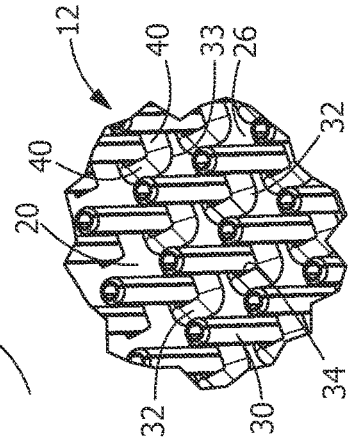
FIG. 2*b* is an enlarged perspective view of a portion of the male electrical connector.
Figure 2:
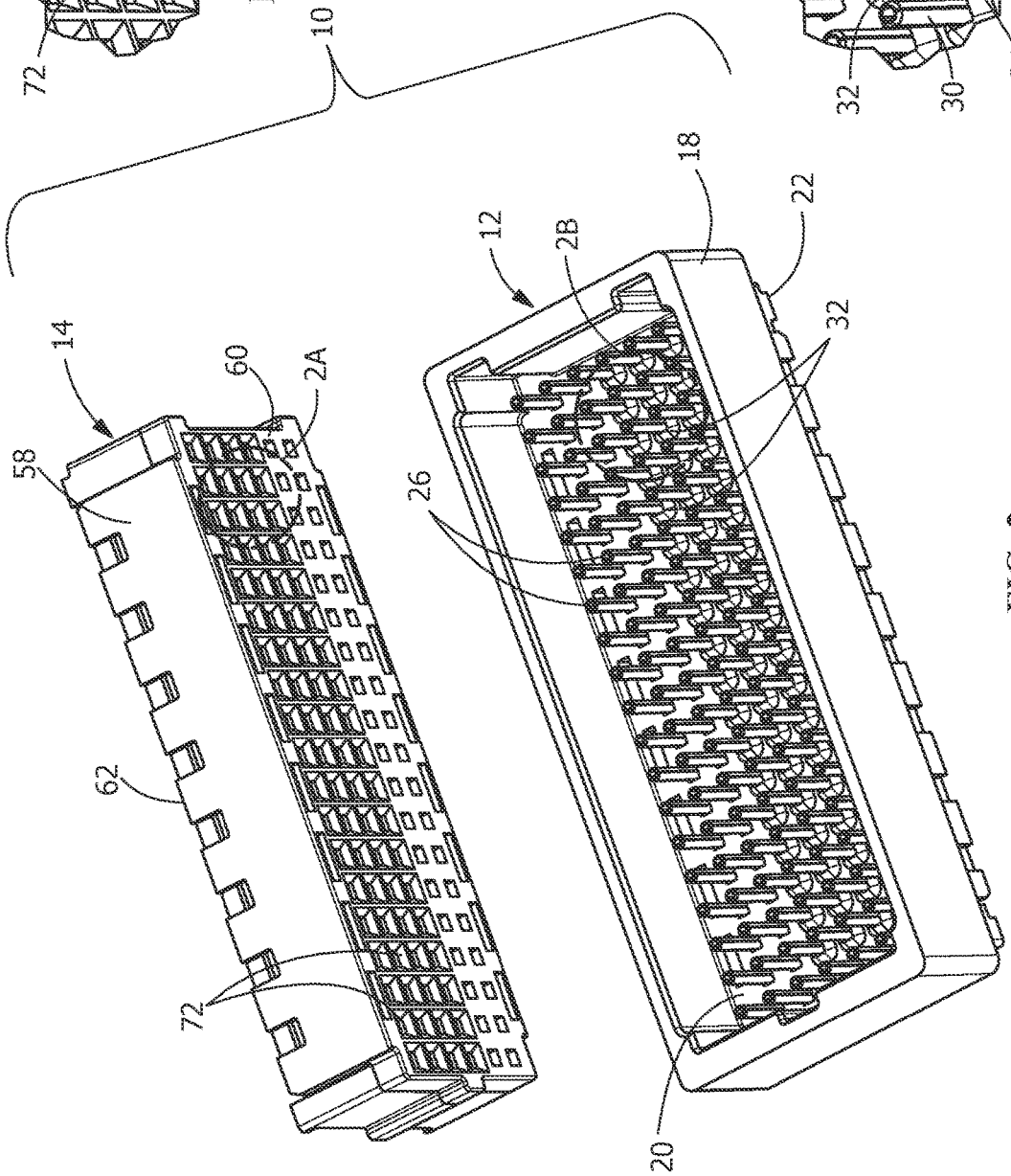
FIG. 2 is a perspective view of the male electrical connector removed from the mating female electrical connector, the connectors are positioned to show the mating interface of both connectors.

As shown in FIGS. 1 and 2, an electrical connector assembly 10 includes a male pin connector 12 and a mating female socket connector 14.

The male pin connector 12 has a housing 18 with a mating surface or face 20 and an oppositely facing wire receiving or mounting face 22. Contact receiving cavities 24 (FIG. 3) extend from the mating face 20 to the mounting face 22.

Figure 3:
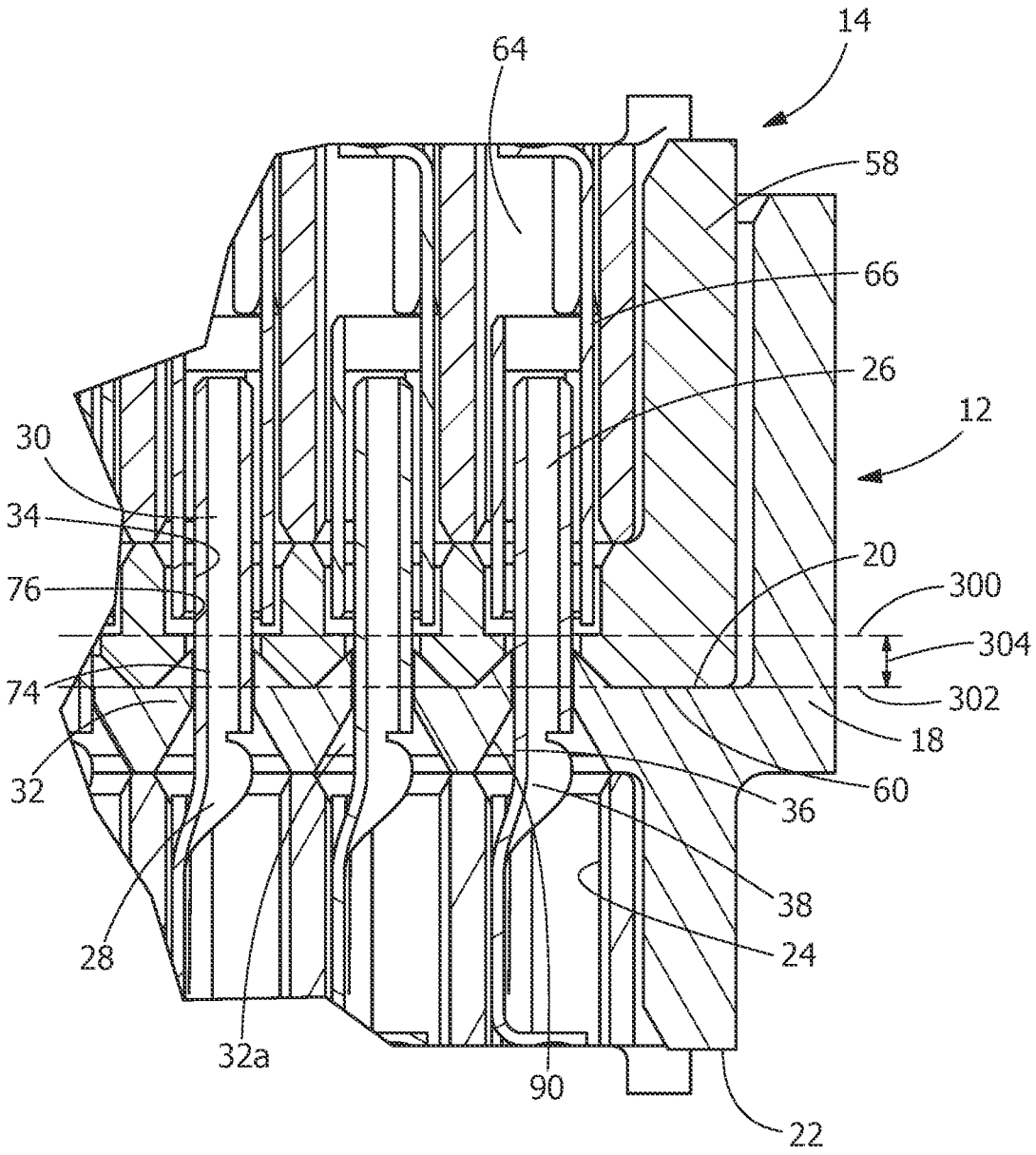
FIG. 3 is a cross-sectional view taken along line 3-3 of FIG. 1, showing the male electrical connector and mating female connector in a mated position.

As shown in FIG. 3, contacts 26 are positioned in the contact receiving cavities 24. The contacts 26 have first portions 28 which are positioned in the contact receiving cavities 24 and second portions or mating portions 30 which extend from the first portions 28. The first portions 28 are configured to position and maintain the contacts 26 in position relative to the male pin connector 12. The particular configuration of the first portions 28 may vary without departing from the scope of the invention. Securing features (not shown), such as barbs or shoulders, may be provided to facilitate the retention of the first portions 28 in the contact receiving cavities 24. The mating portions 30 extend from the mating face 20 in a direction away from the housing 18. In the illustrative embodiment shown in FIGS. 2 and 3, the mating portions 30 have square cross-sections.

Protrusions 32 extend from the mating face 20. The protrusions 32 extend in a direction away from the mating face 20 and the housing 18. In the illustrative embodiment, the protrusions 32 are molded into the housing 18. The protrusions 32 form reverse chamfers, as will be more fully described. Various configurations of the protrusions 32 may be provided. For example, the protrusions 32 may be provided on at least two sides of each of the mating portions 30 of the contacts 26 or the protrusions 32 may be provided on at all sides of each of the mating portions 30 of the contacts 26.

In the illustrative embodiment shown in FIGS. 2 and 3, the protrusions 32 form a truncated pyramid shape with an opening 34 provide in the center. The openings 34 are configured to allow the mating portions 30 to extend therethrough. Walls 36 of the openings 34 are dimensioned to be proximate to or engage edges 38 of the mating portions 30 of the contacts 26. The walls 36 are configured to have the same cross-sectional shape as the mating portions 30 of the contacts 26. In the illustrative embodiment shown in FIGS. 2 and 3, each of the protrusions 32 have four side walls 40 which are sloped from the mating face 20 to the center opening 34. The angle of inclination of the side walls 40 from the mating surface 20 may vary, but will generally be between 35 degrees and 60 degrees as measured from the mating face 20.

The female socket connector 14 has a housing 58 with a mating surface or face 60 and an oppositely facing wire receiving or mounting face 62. Contact receiving cavities 64 extend from the mating face 60 to the mounting face 62.

Contacts 66 are positioned in the contact receiving cavities 64. The contacts 66 have mating contact receiving portions 68 which are positioned in the contact receiving cavities 64. The mating contact receiving portions 68 are configured to position and maintain the contacts 66 in position relative to the female socket connector 14. The mating contact receiving portions 68 are also configured to receive the mating portions 30 of the contacts 26 therein, when the male pin connector 12 is mated to the female socket connector 14. The particular configuration of the mating contact receiving portions 68 may vary without departing from the scope of the invention. Securing features (not shown), such as barbs or shoulders, may be provided to facilitate the retention of the mating contact receiving portions 68 in the contact receiving cavities 64. The mating contact receiving portions 68 extend from the mating face 60 toward the mounting face 62. In the illustrative embodiment shown in FIGS. 2 and 3, the mating contact receiving portions 68 and the contact receiving cavities 64 have square cross-sections.

Lead-in chamfers 72 are provided in the mating face 60. The lead-in chamfers 72 are provided to guide help align and guide the mating portions 30 of the contacts 26 with the mating contact receiving portions 68 of the contact 66 when the male pin connector 12 and the female socket connector 14 are mated.

The lead-in chamfers 72 extend in from the mating face 60 in a direction toward the mounting face 62. In the illustrative embodiment, the lead-in chamfers 72 are molded into the housing 58. The lead-in chamfers 72 has the same shape of the protrusions 32 of the mating male pin connector 12. A circumference of a chamfer base 73 of each of the lead-in chamfers 72 as measured at the mating face 60 is larger than a circumference of a protrusion base 33 of each of the protrusions 32 as measured at the mating face 20. Various configurations of the lead-in chamfers 72 may be provided. For examples, the lead-in chamfers 72 may be provided on at least two sides of each of the mating contact receiving portions 68 of the contact 66 or the lead-in chamfers 72 may be provided on at all sides of each of the mating contact receiving portions 68 of the contact 66.

In the illustrative embodiment shown in FIGS. 2 and 3, the lead-in chamfers 72 form an inverted truncated pyramid shape with an opening 74 provide in the center. The openings 74 are configured to allow the mating portions 30 to extend therethrough. Walls 76 of the openings 74 are dimensioned to be proximate to or engage edges 38 of the mating portions 30 of the contacts 26. The walls 76 are configured to have the same cross-sectional shape as the mating portions 30 of the contacts 26. In the illustrative embodiment shown in FIGS. 2 and 3, each of the lead-in chamfers 72 have four side walls 80 which are sloped from the mating face 60 to the center opening 74. The angle of inclination of the side walls 80 from the mating face 60 may vary, but will generally be between 35 degrees and 60 degrees as measured from the mating face 60, and will be generally equal to or approximately equal to the angle of inclination 42 of the sidewalls 40 of the protrusions 32.

Figure 4:
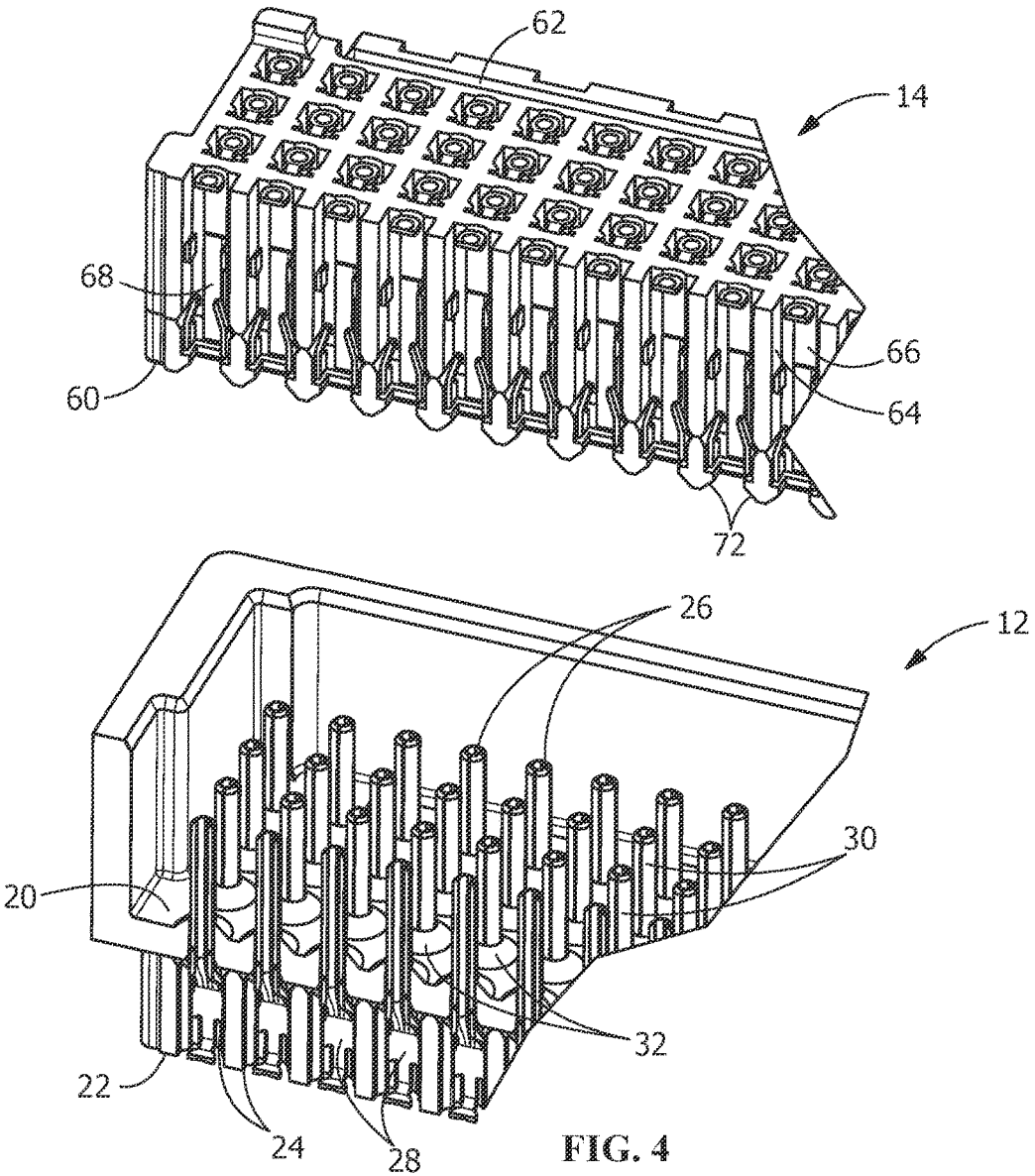
FIG. 4 is a perspective view of an alternate illustrative embodiment of the male electrical connector removed from the mating female electrical connector, the connectors are positioned to show the mating interface of both connectors.
Figure 5:
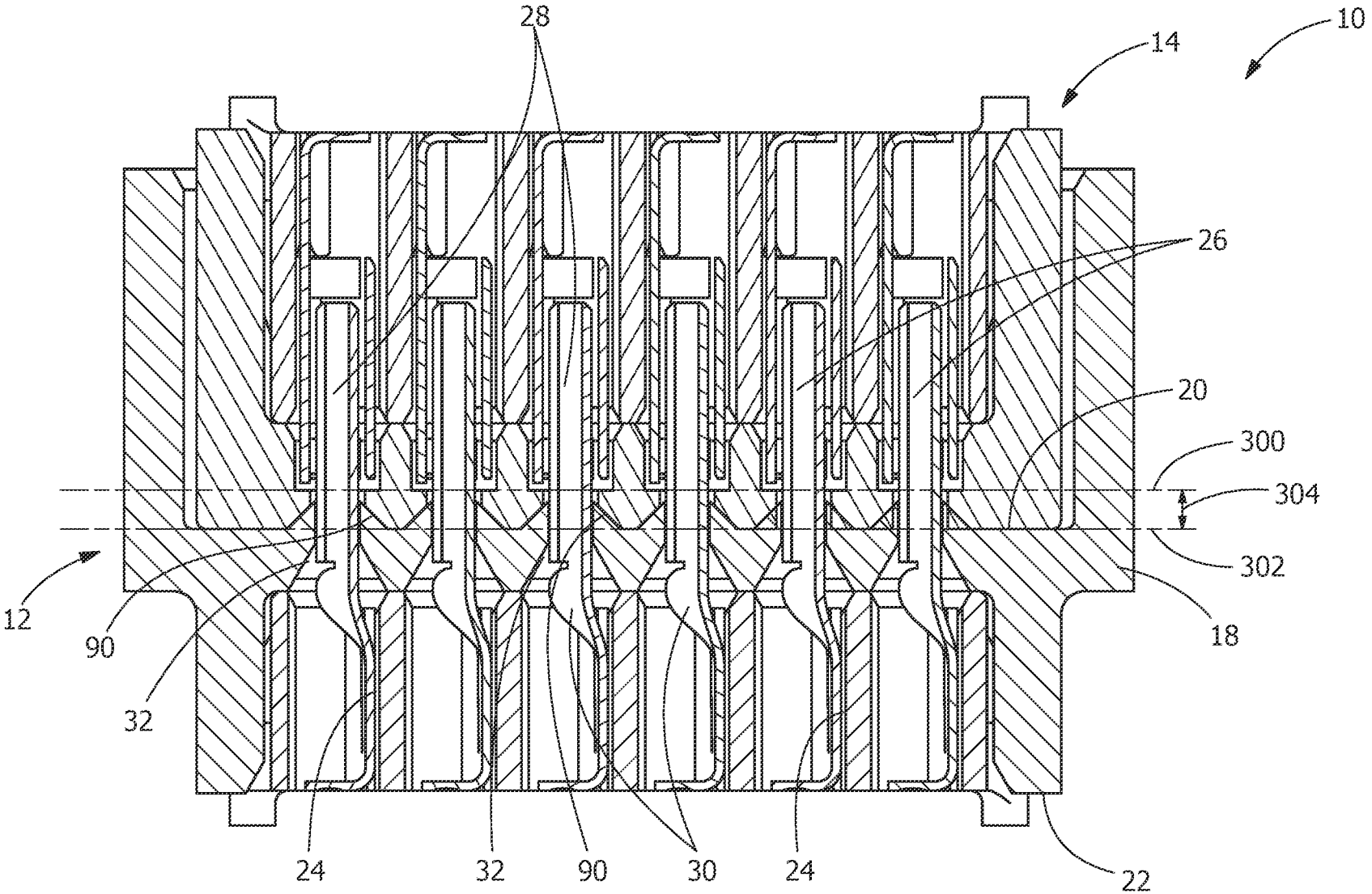
FIG. 5 is a cross-sectional view of the male electrical connector and mating female electrical connector of FIG. 4, showing the male electrical connector and mating female connector in a mated position.

In the illustrative embodiment shown in FIGS. 4 and 5, the mating portions 30 of the contacts 26 of the male pin connector 12 have round cross-sections. However, the mating portions 30 may have other cross-sectional shapes, such as, but not limited, to oval, rectangular, or rounded square.

In the illustrative embodiment shown in FIGS. 4 and 5, the protrusions 32 form a truncated cone shape with an opening 34 provide in the center. The openings 34 are configured to allow the mating portions 30 to extend therethrough. Walls 36 of the openings 34 are dimensioned to be proximate to or engage edges 38 of the mating portions 30 of the contacts 26. The walls 36 are configured to have the same cross-sectional shape as the mating portions 30 of the contacts 26. In the illustrative embodiment shown in FIGS. 4 and 5, each of the protrusions 32 has a side wall 40 which is sloped from the mating face 20 to the center opening 34. The angle of inclination 42 of the side walls 40 may vary, but will generally be between 35 degrees and 60 degrees as measured from the mating face 20.

In the illustrative embodiment shown in FIGS. 4 and 5, the lead-in chamfers 72 form an inverted cone shape with an opening 74 provide in the center. The openings 74 are configured to allow the mating portions 30 to extend therethrough. Walls 76 of the openings 74 are dimensioned to be proximate to or engage edges 38 of the mating portions 30 of the contacts 26. The walls 76 are configured to have the same cross-sectional shape as the mating portions 30 of the contacts 26. In the illustrative embodiment shown in FIGS. 4 and 5, each of the lead-in chamfers 72 have side walls 80 which are sloped from the mating face 60 to the center opening 74. The angle of inclination 82 of the side walls 80 may vary, but will generally be between 35 degrees and 60 degrees as measured from the mating face 60, and will be generally equal to or approximately equal to the angle of inclination 42 of the sidewalls 40 of the protrusions 32.

Regardless of the particular configurations of the protrusions 32 and the lead-in chamfers 72, when the male pin connector 12 and the mating female socket connector 14 are properly mated, the protrusions 32 are positioned or nested in the lead-in chamfers 72. With the protrusions 32 properly positioned or nested in the lead-in chamfers 72, the material, such as, but not limited to plastic, of the protrusions 32 fills in air space or gaps 90 (FIGS. 3 and 5) that are created by the lead-in chamfer 72 on the socket connector 14. The protrusions 32 fill in the air gaps 90, causing a better impedance match in the area between the pin connector 12 and the socket connector 14.

Figure 6:
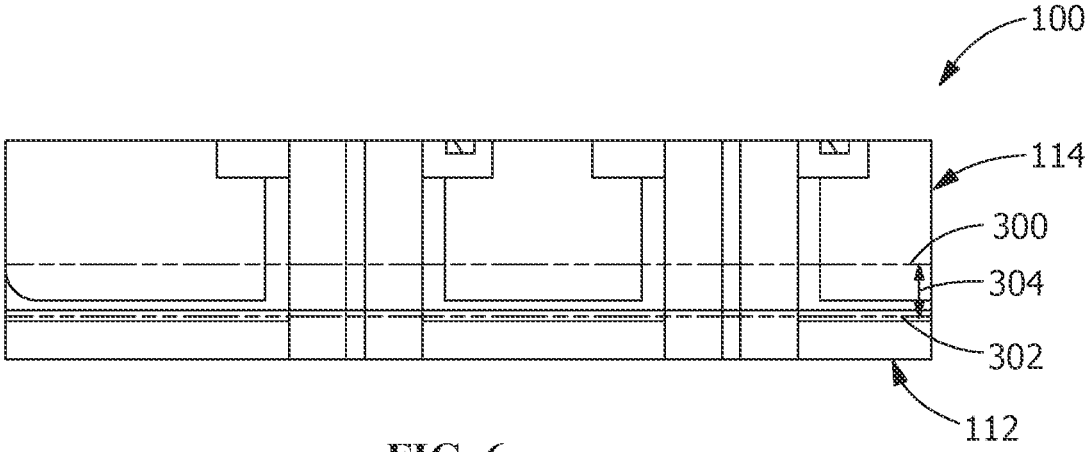
FIG. 6 is a cross-sectional view of a first known prior art male electrical connector and known mating female electrical connector, showing the electrical connector and mating connector in a mated position.
Figure 7:
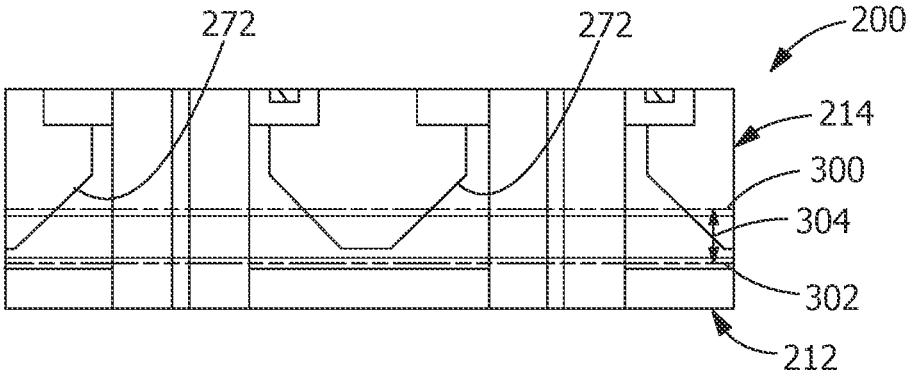
FIG. 7 is a cross-sectional view of a second known prior art male electrical connector and known mating female electrical connector, showing the male electrical connector and mating female electrical connector in a mated position.

Referring to FIG. 6 a first connector assembly 100 according to the prior art has a male pin connector 112 and a female socket connector 114. In this embodiment, no protrusions or lead-in chamfers are provided. Referring to FIG. 7, a second connector assembly 200 according to the prior art has a male pin connector 212 and a female socket connector 214. In this embodiment, no protrusions are provided on the male pin connector 212, but lead-in chamfers 272 are provided on the female socket connector 214.

In each of FIGS. 3, 6 and 7, a first plane 300 and a second plane 302 are shown. The first plane 300 is spaced from the mating face 20, 120, 220 of the male pin connector 12, 112, 212 the same distance 304 in all embodiments. The second plane 302 is provided proximate to the mating face 20, 120, 220 of the male pin connector 12, 112, 212.

In illustrative testing of the connector assemblies 10, 100, 200, the impedance was measured as follows:

| POSITION OF MEASURMENT | CONNECTOR ASSEMBLY 10 IMPEDANCE (ohms) | CONNECTOR ASSEMBLY 100 IMPEDANCE (ohms) | CONNECTOR ASSEMBLY 200 IMPEDANCE (ohms) |
|---|---|---|---|
| Plane 302 (FIG. 3, 5 and 6) | 141.3 | 191.2 | 179.3 |
| Plane 300 (FIG. 3, 5 and 6) | 127.4 | 131.9 | 149.3 |
| Average of Plane 302 and Plane 300 | 134.35 | 161.55 | 164.3 |

As shown from the illustrative numbers in the table above, connector assembly 100 has very high impedance across plane 2 because there is no plastic between the pins. The impedance across plane 1 is lower than the impedance across plane 2, as the pins are surrounded by plastic. Consequently, there is a large difference or mismatch between the impedance of plane 1 and plane 2, which can adversely affect the signal transmission of the contacts. The average impedance between plane 2 and plane 1 remains high.

As shown from the illustrative numbers in the table above, connector assembly 200 has very high impedance across plane 2 because there is no plastic between the pins. The impedance across plane 1 is lower than the impedance across plane 2, as the pins are separated by plastic. Consequently, there is a large difference or mismatch between the impedance of plane 1 and plane 2, which can adversely affect the signal transmission of the contacts. However, a larger air gap is provided in connector assembly 200 than connector assembly 100, the impedance across plane 2 is higher in connector assembly 200 than connector assembly 100. The average impedance between plane 2 and plane 1 of connector assembly 200 remains high.

In contrast to the prior art connector assemblies 100, 200, the connector assembly 10 of the present invention lower impedance in both zones and similar impedance in each zone. As shown from the illustrative numbers in the table above, connector assembly 10 has lower impedance across plane 2 than either connector assembly 100 or connector assembly 200. As the protrusions 32 are nested in the lead-in chamfers, there is plastic between the mating portions 30 of the contacts 26 and there is no directed gap between the mating portions 30 of the contacts 26. The connector assembly 10 also has lower impedance across plane 1 than either connector assembly 100 or connector assembly 200. As the protrusions 32 are nested in the lead-in chamfers, there is more plastic between the mating portions 30 of the contacts 26 and the air gaps 90 between the mating portions 30 of the contacts 26 are minimized. The average impedance between plane 2 and plane 1 of connector assembly 10 is also significantly lower than the aver impedance of connector assembly 100 or connector assembly 200.

As the impedance between plane 2 and plane 1 are similar or matched in connector assembly 10, high speed signal transmission can occur without significant loss pf power and with minimal signal reflection.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing having a mating face for mating with a mating electrical connector, contact receiving cavities extending into the housing from the mating face;

contacts in the contact receiving cavities, mating portions of the contacts extending from the mating face in a direction away from the housing;

protrusions extending from the mating face in a direction away from the housing, the protrusions extending proximate edges of the mating portions of the contacts, the protrusions forming reverse chamfers which cooperate with lead-in chamfers provided in a surface of the mating electrical connector;

openings extending through the center for the protrusions, the openings having the same cross-sectional shape as the mating portions of the contacts, the protrusions extend on all sides of the mating portions of the contacts and the openings;

wherein, as the electrical connector is mated with the mating electrical connector, the protrusions are positioned in the lead-in chamfers of the mating electrical connector, the positioning of the protrusions in the lead-in chamfers fills in air gaps provided by the lead-in chamfers to provide an impedance match along the mating portions of the contacts when the electrical connector is mated with the mating electrical connector.

2. The electrical connector as recited in claim 1, wherein the protrusions have a truncated pyramid shape.

3. The electrical connector as recited in claim 1, wherein the protrusions have a truncated cone shape.

4. The electrical connector as recited in claim 1, wherein the protrusions have side walls with angles of inclination as measured from the mating face of between 35 degrees and 60 degrees.

5. The electrical connector as recited in claim 1, wherein cross-sectional areas of the mating portions of the contacts are round.

6. The electrical connector as recited in claim 1, wherein cross-sectional areas of the mating portions of the contacts are oval.

7. The electrical connector as recited in claim 1, wherein cross-sectional areas of the mating portions of the contacts are square.

8. The electrical connector as recited in claim 1, wherein cross-sectional areas of the mating portions of the contacts are rectangular.

9. An electrical connector assembly comprising:

a first electrical connector comprising:

a first housing having a first mating face, first contact receiving cavities extending into the first housing from the first mating face;

first contacts in the first contact receiving cavities, first mating portions of the first contacts extending from the first mating face in a direction away from the first housing;

protrusions extending from the first mating face in a direction away from the first housing, the first protrusions extending proximate edges of the first mating portions of the first contacts, the protrusions forming reverse chamfers;

first openings extending through the center for the protrusions, the first openings having the same cross-sectional shape as the first mating portions of the first contacts, the protrusions extending on all sides of the first mating portions of the first contacts and the first openings;

a second electrical connector comprising;

a second housing having a second mating face, second contact receiving cavities extending into the second housing from the second mating face;

second contacts in the second contact receiving cavities, second mating portions of the second contacts extending from the second mating face in a direction into the second housing;

lead-in chamfers provided in the second mating face of the second housing, the lead-in chamfers extending from the second mating face in a direction into the second housing, the lead-in chamfers having the same shape as the protrusions;

second openings extending through the center for the lead-in chamfers, the second openings having the same cross-sectional shape as the second mating portions of the second contacts, the lead-in chamfers extending on all sides of the second mating portions of the second contacts and the second openings;

wherein, as the first electrical connector is mated with the second electrical connector, the protrusions of the first electrical connector are positioned in the lead-in chamfers of the second electrical connector, the positioning of the protrusions in the lead-in chamfers fills in air gaps provided by the lead-in chamfers to provide an impedance match along the first mating portions of the first contacts when the first electrical connector is mated with the second electrical connector.

10. The electrical connector assembly as recited in claim 9, wherein the protrusions of the first electrical connector have side walls with first angles of inclination as measured from the first mating face of between 35 degrees and 60 degrees.

11. The electrical connector assembly as recited in claim 10, wherein the lead-in chamfers of the second electrical connector side walls with second angles of inclination as measured from the second mating face of between 35 degrees and 60 degrees.

12. The electrical connector assembly as recited in claim 9, wherein the protrusions have a truncated pyramid shape which extend from the first mating surface away from the first housing.

13. The electrical connector assembly as recited in claim 9, wherein the protrusions have a truncated cone shape which extend from the first mating surface away from the first housing.

14. The electrical connector assembly as recited in claim 9, wherein the lead-in chamfers have a truncated pyramid shape which extend from the second mating surface into the second housing.

15. The electrical connector assembly as recited in claim 9, wherein the protrusions have a truncated cone shape which extend from the second mating surface into the second housing.

16. The electrical connector assembly as recited in claim 9, wherein a circumference of a chamfer base of each of the lead-in chamfers at the second mating surface is larger than a circumference of a protrusion base of each of the protrusions at the first mating surface.

* * * * *